US005310394A

United States Patent [19]

Kallios

[11] Patent Number: 5,310,394

[45] Date of Patent: May 10, 1994

[54] SPOTTER SYSTEM FOR WEIGHTLIFTERS

[76] Inventor: Demetrios Kallios, 6421 Monero Dr., Rancho Palos Verdes, Calif. 90274

[21] Appl. No.: 997,552

[22] Filed: Dec. 28, 1992

[51] Int. Cl.[5] ..... A63B 21/078

[52] U.S. Cl. ..... 482/104; 482/93

[58] Field of Search ..... 482/101, 1-9, 482/104, 93, 94, 96, 108

[56] References Cited

U.S. PATENT DOCUMENTS

| | | | |
|---|---|---|---|
| 4,249,726 | 2/1981 | Faust | 482/104 X |
| 4,253,662 | 3/1981 | Podalak | 482/104 |
| 4,349,192 | 9/1982 | Lambert, Jr. et al. | 482/101 |
| 4,561,651 | 12/1985 | Hole | 482/104 |
| 4,949,959 | 8/1990 | Stevens | 482/104 |
| 4,998,721 | 3/1991 | Anders et al. | 482/104 X |
| 5,190,510 | 3/1993 | Goodger | 482/104 |

*Primary Examiner*—Stephen R. Crow

*Assistant Examiner*—Glenn E. Richman

*Attorney, Agent, or Firm*—Roger Marrs

[57] ABSTRACT

A spotter system is disclosed herein for assisting a weightlifter to safely exert a maximum effort during a weightlifting procedure. The system includes a frame for removably supporting a weight arrangement comprised of either free or track weights. The frame further supports a pneumatic lift which includes cables secured at one end to the barbell and at their opposite ends to a pulley. Via a chain drive from the pulley, an intermediate wheel is moved which, in turn, pivots a lever arm. The lever arm is attached at one end to a piston and cylinder assembly that offers less resistence to the users exerted effort to raise the barbell. Control of the resistence is effected by body limb activation of positive or negative switches coupled to the piston and cylinder assembly which further includes an air compressor, gages and relief valves.

1 Claim, 2 Drawing Sheets

SPOTTER SYSTEM FOR WEIGHTLIFTERS

BACKGROUND OF THE INVENTION

1. Field of the Invention

The present invention relates to the field of exercising apparatus and more particularly to a novel exercise apparatus incorporating a controlled weight resistence means so that a weightlifter may exert maximum effort in safety and without assistance from another person.

2. Brief Description of the Prior Art

Conventionally, it is the practice in the exercise field to employ free or machine weights in an effort to increase the strength and good health of the user. Normally, the user will place the weights on the end of a bar or in a stack and proceed to lift the bar employing the weights as resistance so that the muscles of the particular body group are thoroughly exercised. The practice is usually to perform a number of repetitions in a particular set and then to use a certain number of sets in order to complete the exercise.

For maximum body muscle strength, the user attempts to exert all of his strength on the last one or two repetitions of each set, and in this connection, a helper is generally asked to place fingers under the weights to assist the lifter in the event full exertion exhausts the muscles to where the lifter cannot make the final repetition. The alternate is to not use a spotter and this is extremely dangerous to the lifter since muscle exertion and exhaustion may cause the weights to drop and the lifter may be damaged thereby. Another problem and difficulty has been encountered which stems from the fact that the user or lifter has no control over the resistance of the weights as the repetitions are being performed in each set. Usually, to change resistance, the user must stop the procedure and immediately place or remove weights until the desired amount of resistance is achieved. Then the exercise is resumed. Obviously, this wastes time, and, more importantly, interrupts the purpose of timed repetitions in each set.

Some attempts have been made to provide a change in resistance by employing controlled pressure, a variety of cam assemblies or the like, and these arrangements have not been successful because they either require frequent manual changing by either the lifter or an assistant but remain a static system requiring the temporary cessation of the exercise while the adjustment is being made.

Therefore, a long-standing need has existed to provide a dynamic means in an exercising machine which will permit the user or lifter to vary the amount of resistance during the exercise procedure without stopping the procedure or requiring independent assistance to rearrange the resistance.

SUMMARY OF THE INVENTION

Accordingly, the above problems and difficulties are overcome by the present invention which provides a frame supporting a pneumatic assistance lifting means for free or stacked weights having an adjustable pneumatic piston and cylinder assemblage operably connected to the weighted barbell via a lever and pulley arrangement and cables extending between the barbell and the lever and pulley arrangement so that the resistence of the weighted barbell can be adjusted during an exercise procedure via the lifter or users limbs.

Control means are included in combination with an air compressor air gages, and pneumatic switches to monitor the pressure values and to set pressure levels.

Therefore, it is among the primary objects of the invention to provide a novel means for assisting a weightlifter to exert maximum effort to bear against a weighted resistence without the assistance of a spotter or helper.

Another object of the invention resides in the provision of a pneumatic or hydraulic pressure assist mechanism which safely permits a lifter to adjustably control the resistence against which he exerts maximum exercising effort.

A further object of the invention resides in a novel spotter system which allows compressed air, at the selection of the user, to carry the weight at an even rate of consistency so that more repetitions can be added to an exercise procedure.

Yet another object resides in allowing a weightlifter to push himself beyond his regular repetition limit in a safe manner without separate or independent assistance.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
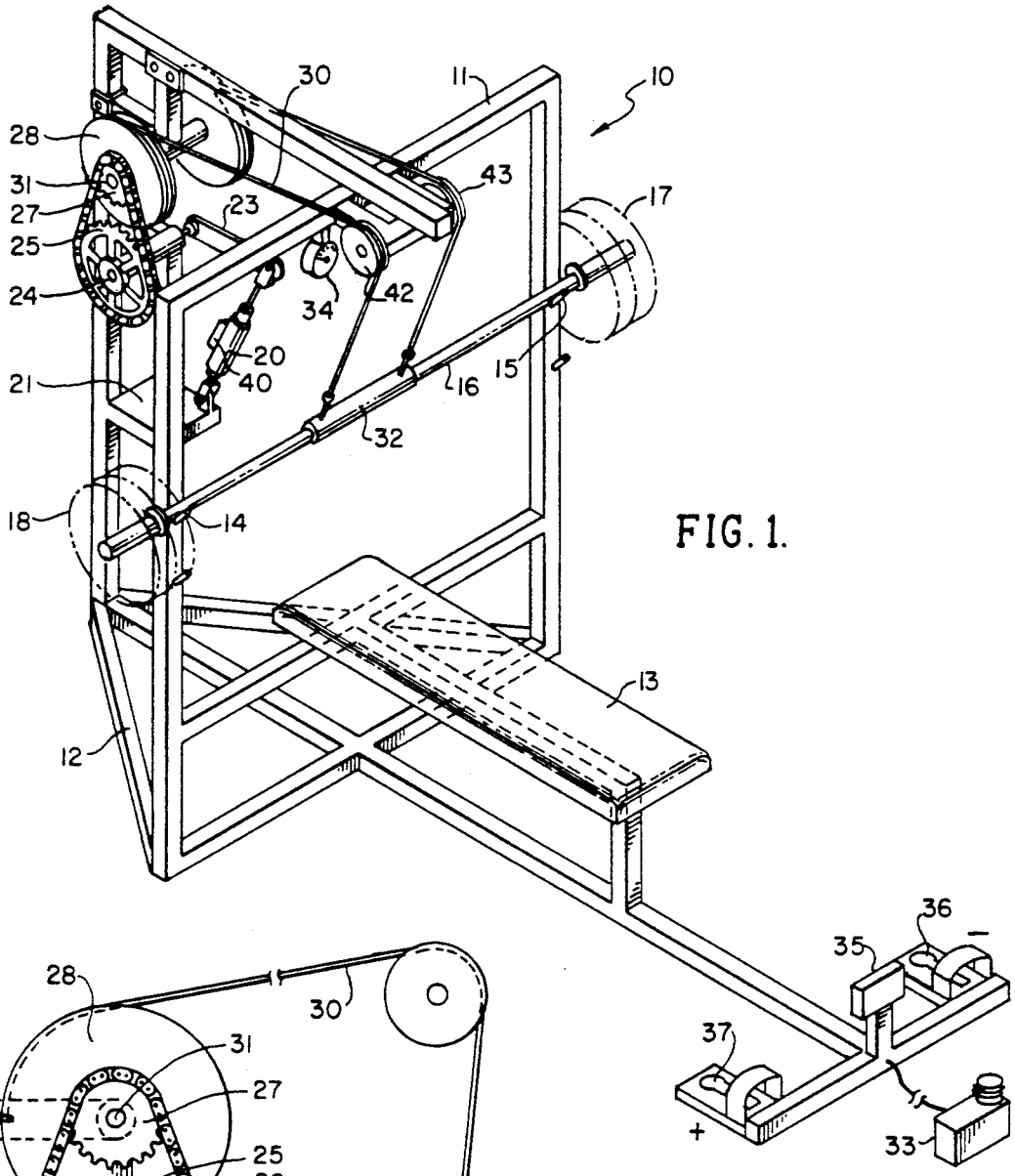
FIG. 1 is a front perspective view showing the novel spotting system for weightlifters incorporating the present invention.

Referring to FIG. 1, the novel apparatus incorporating the spotting system of the present invention is illustrated in the general direction of arrow 10 which includes a frame 11 having a supporting base 12 of triangular configuration which supports upright members and crossbar members in order to mount and support the various components of the system. For illustrative purposes, the frame is illustrated as supporting a horizontal bench 13; however, it is to be understood that other supports may be included, such as an incline bench or no bench at all should the user intend to perform other exercises for different body groups, such as kneeling on the floor under the frame 11 and performing the exercise in that position.

Figure 2:
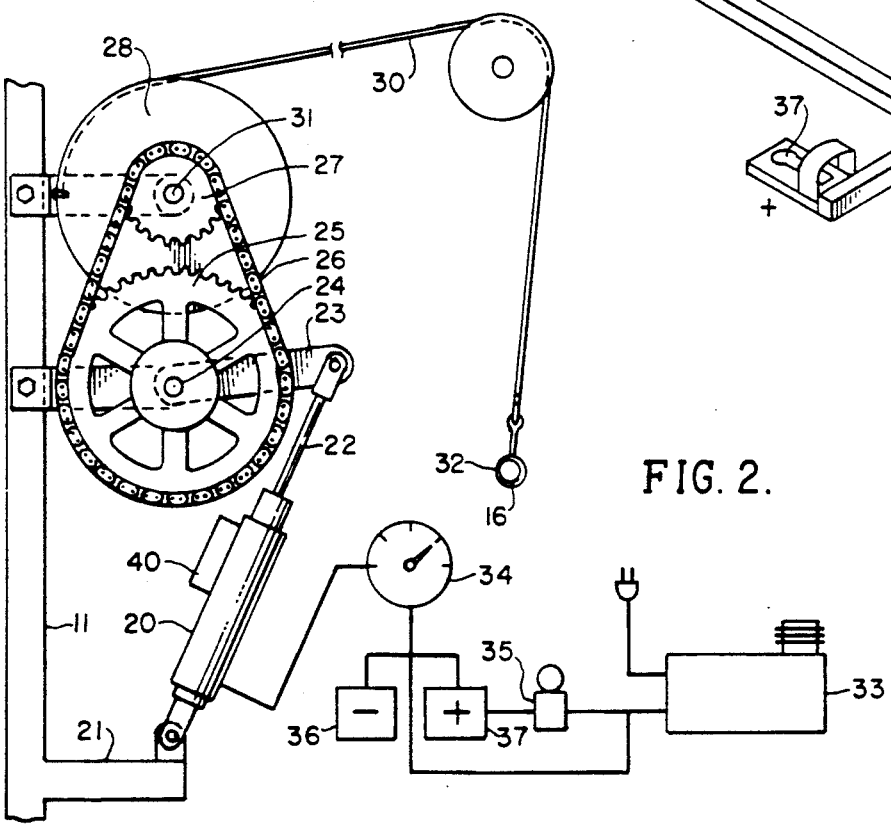
FIG. 2 is a diagrammatic side elevational view of the apparatus shown in FIG. 1.

The example of the apparatus shown in FIG. 1 includes a plurality of pins, such as pins 14 and 15 which are employed for temporarily supporting a barbell 16 having free weights, as indicated by numerals 17 and 18, carried on opposite ends of the bar. During an exercising procedure, the lifter generally raises the bar 16 including the end weights from the supports 14 and 15 and then commences doing repetitions for a given number or until near exhaustion. In order to keep the barbell from dropping onto the lifter when a point of exhaustion has been reached and/or to assist the lifter in providing full exertion of effort to raise the weighted bar 16, the spotting system of the present invention includes means for partially supporting the weighted bar during the exercise procedure. This means includes a piston and cylinder assemblage, as illustrated in FIG. 2 by numeral 20, to a platform 21 while the piston 22 is pivoted to a movable link 23. The opposite end of the link 23 is fixed to a rotatable shaft 24 that is rotated either clockwise or counterclockwise in response to the turning of a gear 25 by means of chain 26. Chain 26 is moved by means of an intermediate gear 27 which is attached to a pulley 28 having a cable 30 connected at one end thereto and at its opposite end to a holder 32 on the central area of the bar 16.

As shown more clearly in FIG. 1, a pair of pulleys is illustrated as being carried on a common shaft 31 and a pair of cables 30 is employed which terminate in securement with the holder 32. Therefore, it can be seen that as the rod 22 moves in and out of the cylinder of the piston and cylinder assemblage 20, the link or lever 23 is moved up and down in a small arc of rotation. Conversely, as the cables 30 are either pulled down or relaxed in accordance with the movement of the barbell 16, the pulley and gear arrangement via the chain 26 will cause the lever or link 23 to pivot against the resistance of the air pressure within the piston and cylinder assemblage.

Referring now in detail to FIG. 2, the system 10 includes an air compressor 33 which is coupled to the cylinder of the piston and cylinder assembly 20 by conduits and which includes an air gauge 34 showing a scale of between 1-250 psi reading by means of an internal needle. The compressor 33 includes an air dryer and an airline gauge is indicated by numeral 35 which includes a manual adjust so that actuator switches may be properly adjusted for pneumatic control on the piston and cylinder assemblage for the amount of weight being used. In the present invention, the actuator switches are indicated by numerals 36 and 37 which are intended to be operated by the limbs of the lifter, such as his feet. As illustrated in FIG. 1, the lifter's feet are placed within the loops switches that take the form of pedals that are pivoted to open and close the respective line from the gauge 35 to the piston and cylinder assemblage. An air reservoir is indicated by numeral 40 which is intended to relieve pressure in the piston and cylinder assemblage in response to actuation of the foot pedal switches. The positive pedal 37 may be manually adjusted when desired to place more or less pressure in the piston and cylinder assembly 20. The reservoir takes air from the cylinder to relieve pressure when extra air accumulates therein. A constant feed of air pressure, approximately 20 pounds, is present in the line and the air line constant feed of 20 pounds is employed or whatever amount is desired by the user through adjustment. In any event, it is to be understood that the resistance to the lifter's effort is still using the free weights or machine stacked weights.

Figure 3:
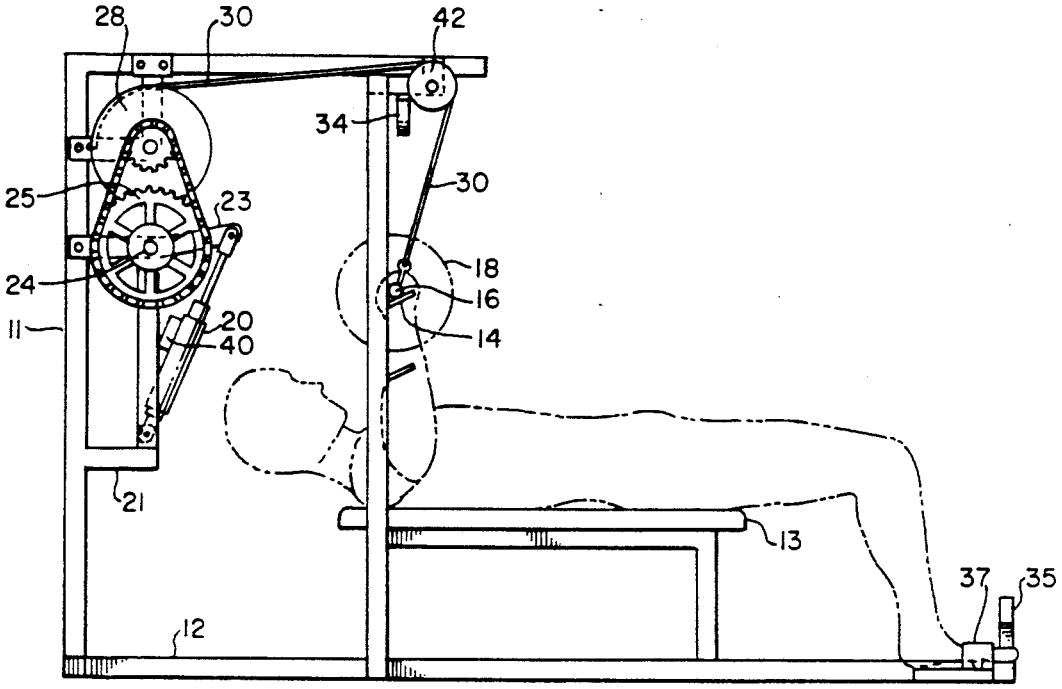
FIG. 3 is a side elevational view of the apparatus shown in FIG. 1 illustrating a weightlifter in a prone position preparatory for lifting the free weights from the frame.
Figure 4:
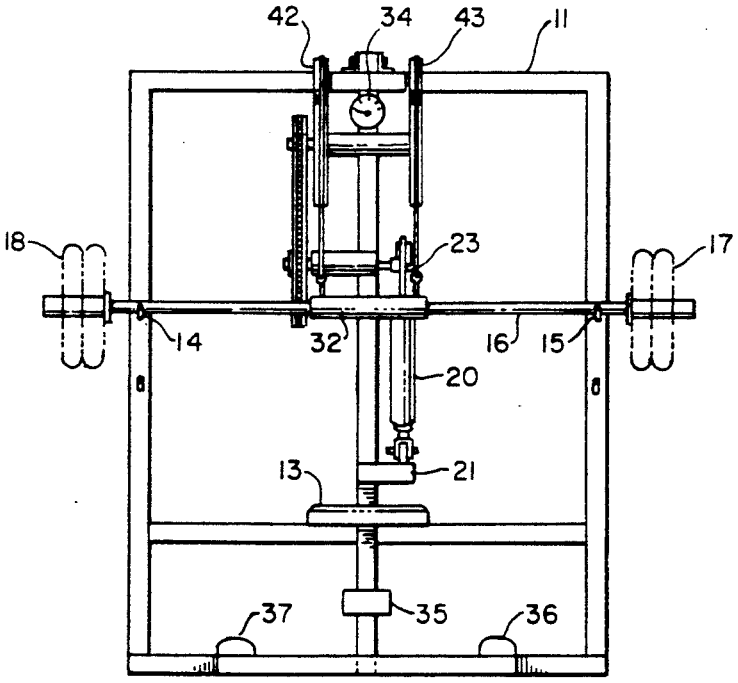
FIG. 4 is a front elevational view of the apparatus shown in FIG. 1.

FIGS. 3 and 4 further illustrate the components of the spotter system as placed on the frame and base. Gauge 34 is preferably placed between the pair of intermediate pulley wheels 42 and 43 so that the user may view the pressure during the exercising procedure.

In view of the foregoing, it can be seen that the spotter system of the present invention employs a hydraulic pneumatic resistance system for assisting the lifter in raising free weights during an exercising procedure. The inventive spotter system insures the safety of the lifter and allows a maximum workout that any person can handle. The apparatus is based on the use of traditional stack or free weights and the apparatus does not add to the weight but assists in the lift procedure. Conventional weights are attached to the cables 30 by means of the holder 32 and when the system is activated, the system will commence to pick up the weights allowing the weights to become lighter so that the person who is lifting can continue the exercise procedure to complete his repetition. This will allow the lifter to push himself at the strain point of lifting and at least many times harder than the lifter could do on a regular free weight stand or machines so that the lifter's results are greater than before.

In actual practice, when a person's muscles become so tired that he cannot go any further, normally this is a situation that would be the end of that particular repetition or lift. At the point when a person cannot go any further, is the point where the lifter or person gets the most results. Instead of ending the lift, the use of the inventive apparatus allows the lifter to activate the foot or hand controls, depending on where the controls are located, which allows the compressed air into the air system. The air system, when activated, will start to carry weight at an even rate of consistency, allowing the lifter to push-up to many more repetitions for a particular set of repetitions. By use of this procedure, the person becomes stronger than he could otherwise do on conventional systems.

By use of the present invention, the lifter need not rely on a friend to spot him when working out. Conventionally, hard lifters realize that a spotter is needed who can spot them well enough so that they can get their maximum workout. The inventive apparatus allows the lifter to get a perfect spot every time without the need of a friend or associate.

The inventive system commences with the air compressor 33 so that pressurized air is fed into an air line which goes into an internal air-dryer. The air dryer takes or removes the moisture in the air. The air line then proceeds to the positive valve 37 of the spotter system. This valve needs to be activated manually by the lifter. Subsequent to the positive valve, there is provided an air pressure gauge 34 which tells the lifter how many pounds are in the spotter system. This line goes into the air reservoir tank and the piston and cylinder assemblage 20. The piston and cylinder assemblage carries some weight from the weight bar acting like a spotter. When the lifter applies too much pressurized air into the system or he wants to take the air out of the system, the lifter actuates the negative air valve 36 to release the air. The harmless air goes back into ambient air.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An exercising apparatus providing for maximum lifting effort in safety comprising the combination of:

a frame;

weight means carried on said frame;

torque reduction means operably carried on said frame and engaged with said weight means to ease resistance encountered by the user during an exercise procedure;

said torque reduction means to ease resistance includes a controllable swing arm assembly means and linkage means engageable with said weight means;

said controllable swing arm assembly means having a piston and cylinder means connected with said linkage means and with a reservoir cylinder for selectively changing pressure to control the pull on said linkage means without fluctuation to assist in the lift of said weight means during said exercising procedure;

said linkage means includes an electric motor means and a cable and pulley combination and a lever pivotally carried on said controllable swing arm assembly whereby pivoting of said lever follows movement of said weight means by the user whereby said piston and cylinder follow the command of the user;

control means interconnecting with said controllable swing arm assembly means for selecting the pressure in said controllable swing arm assembly means;

switch means in said control means operable by the limbs of the user to adjust the pressure in said piston and cylinder means; and said lever having two ends, one end connected to a pulley in said linkage means and its other end pivotally connected to said controllable swing arm assembly means.

* * * * *